US005624779A

United States Patent [19]

Nakayama

[11] Patent Number: 5,624,779

[45] Date of Patent: Apr. 29, 1997

[54] TONER FOR ELECTROPHOTOGRAPHY AND PROCESS FOR PRODUCING THE SAME

[75] Inventor: Koji Nakayama, Shizuoka, Japan

[73] Assignee: Tomoegawa Paper Co, Ltd., Tokyo, Japan

[21] Appl. No.: 504,156

[22] Filed: Jul. 19, 1995

[30] Foreign Application Priority Data

Jul. 19, 1994 [JP] Japan ..... 6-187902

[51] Int. Cl.[6] ..... G03G 9/00

[52] U.S. Cl. ..... 430/109; 430/137

[58] Field of Search ..... 430/109, 137

[56] References Cited

U.S. PATENT DOCUMENTS 4,965,160 10/1990 Nagatsuka et al. ..... 430/109

5,397,671 3/1995 Bayley et al. ..... 430/109

*Primary Examiner*—Mark Chapman

*Attorney, Agent, or Firm*—Cushman Darby & Cushman IP Group of Pillsbury Madison & Sutro, LLP

[57] ABSTRACT

A toner for electrophotography and a process for producing the same are disclosed. The toner is formed from particles which are formulated from at least a cured composition which contains at least a binder resin having an unsaturated double bond, and can also contain a reactive monomer, a radical-polymerization catalyst, and a catalyst. The resulting particles each have a crosslinking density that gradationally increases from the center towards the surface of the particle. The toner of the present invention is fixable at low temperatures, has no problems associated with storage stability in practical use, and can be firmly fixed to receiving paper.

19 Claims, No Drawings

TONER FOR ELECTROPHOTOGRAPHY AND PROCESS FOR PRODUCING THE SAME

FIELD OF THE INVENTION

The present invention relates to a toner for electrophotography, in particular an electrophotographic toner for use in a copier or printer which employs heat roll fixing. The present invention also relates to a process for producing the toner.

BACKGROUND OF THE INVENTION

With the recent spread of copiers and printers which are based on electrophotography, accompanying demands have been made that these copiers and printers be energy-saving (diminished power consumption), particularly in the are of domestic use, possess an increasing number of functions, and be capable of being operated at a higher speed particularly for the so-called gray area located between printing machines and copiers. There also is demand for copiers or printers which can be operated at a lower rolling pressure to thereby simplify the fixing-roll and reduce machine cost. In addition, since copiers that have a double-side-copying function or are equipped with an automatic document feeder have spread widely, due to the trend toward shifting to higher-grade copiers, the electrophotographic toners employed in such copiers and printers are required to have a low fixing temperature, to be less apt to cause offset, and to display excellent affixing strength to receiving paper so as to avoid smearing during both-side copying and automatic document feeder operations.

To meet the requirements described above, the following prior art techniques, which involve utilizing a binder resin having an improved molecular weight or improved molecular weight distribution, have been proposed.

Specifically, an attempt has been made to employ a binder resin having a reduced molecular weight to thereby attain a lower fixing temperature. However, the reduction in molecular weight has also resulted in a reduced viscosity and a lower melting point. Consequently, offset to the fixing roll may result. To avoid this offset phenomenon, a technique of modifying the molecular weight distribution of the binder resin by widening the low-molecular-weight region and high-molecular-weight region thereof and a technique of crosslinking a high-molecular part of the binder resin have been employed. However, use of these techniques necessitates a reduction in the glass transition temperature of the resin so as to impart sufficient fixability to the toner, which unavoidably impairs the storage stability of the toner formed.

SUMMARY OF THE INVENTION

Accordingly, an object of the present invention is to provide a toner for electrophotography which is fixable at a low fixing temperature, is suitable for storage in practical use, and exhibits excellent bonding to paper received by roll fixing.

The essential aspects of the present invention, which has been achieved in order to accomplish the above object, reside in a toner for electrophotography which is composed of at least a cured composition, the composition in an uncured state containing at least a binder resin having an unsaturated double bond, a radical-polymerization catalyst, a reactive monomer, and a colorant. Another such aspect of the present invention resides in a process for producing a toner for electrophotography which comprises curing particles of a mixture of these ingredients by means of a heat treatment or application of a mechanical impact force to produce toner particles in each of which the degree of cure gradationally increases toward the toner surface.

DETAILED DESCRIPTION OF THE INVENTION

The binder resin for use in the present invention has a double bond. Suitable examples of the binder resin having a double bond include polybutadiene, unsaturated polyester resins, and various resins modified with an unsaturated monomer. The content of the binder resin having an unsaturated double bond in the toner according to the present invention is generally from 6 to 70% by weight.

Of the binder resins having a double bond, unsaturated polyester resins are preferred in that the control of molecular weight, $T_g$, electrification characteristics, etc. thereof is easy, the resins have high strength, and long-life properties can be imparted to the resins. The number-average molecular weight of the unsaturated polyester resin for use in the present invention is generally from 2,000 to 15,000.

Examples of diol components of the unsaturated polyester resins for use in this invention include polyoxypropylene (2,2)-2,2-bis(4-hydroxyphenyl)propane, polyoxypropylene (3,3)-2,2-bis(4-hydroxyphenyl)propane, polyoxyethylene(2,0)-2,2-bis(4-hydroxyphenyl)propane, polyoxypropylene (2,0)-polyoxyethylene(2,0)-2,2-bis(4-hydroxyphenyl) propane, polyoxypropylene(6)-2,2-bis(4-hydroxyphenyl) propane, ethylene glycol, 1,2-propylene glycol, 1,3-propylene glycol, 1,4-butanediol, neopentyl glycol, 1,5-pentanediol, and 1,6-hexanediol.

Examples of unsaturated diol components in this invention include 1,4-butenediol and 1,6-hexenediol. Examples of trihydric and higher alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxybenzene. Examples of acid components include phthalic acid, isophthalic acid, terephthalic acid, cyclohexanedicarboxylic acid, adipic acid, sebacic acid, and malonic acid. Examples of unsaturated acid components include fumaric acid, maleic acid, maleic anhydride, citraconic acid, itaconic acid, succinic acid, alkenylsuccinic acids, and pentenedicarboxylic acid.

Examples of tricarboxylic and higher carboxylic acids include 1,2,4-benzenetricarboxylic acid, 2,5,7-naphthalenetricarboxylic acid, 1,2,4-naphthalenetricarboxylic acid, 1,2,4-butanetricarboxylicacid, 1,2,5-hexanetricarboxylic acid, 1,3-dicarboxyl-2-methyl-2-methylenecarboxypropane, tetra(methylenecarboxyl)methane, and 1,2,7,8-octanetetracarboxylic acid.

The unsaturated polyester for use in the present invention can be prepared according to any conventional method. For example, an unsaturated polyester resin having a peak molecular weight of 4,500, a Tg of 54° C. and a melting initiation temperature of 80° C. was prepared as follows. One hundred grams of polyoxypropylene (2,0)-2,2-bis(4-hydroxyphenyl)propane as an alcohol component and 33.7 g of fumaric acid as an acid component, and 0.134 g of dibutyl tin oxide and 0.134 g of hydroquinone were charged into a four-necked round flask equipped with a stirrer, a condenser and a gas-introducing tube, and while nitrogen gas was introduced through the gas-introducing tube, the contents were heated while stirring at 150° C. for 1.5 hours. Thereafter, the contents were heated while stirring at 180° C. for 2 hours, 200° C. for 2 hours, and 220° C. for 2 hours in sequence, to conduct condensation polymerization. Thus, an unsaturated polyester resin having the above-described properties was obtained.

In producing the toner for electrophotography of the present invention, the binder resin having an unsaturated double bond and a reactive monomer are subjected to a heat treatment in the presence of a polymerization catalyst. It is thought that as a result of this heat treatment, a three-dimensional network structure is formed on the toner surface. This crosslinking reaction heightens the $T_g$ or strength of the toner surface to improve heat resistance. Even if the toner particles have a low $T_g$, storage stability of the toner is not impaired. Therefore, the binder resin having an unsaturated double bond for use in this invention preferably has a glass transition point (hereinafter referred to as $T_g$) of 60° C. or lower. The lower limit is preferably 40° C. If the $T_g$ is higher than 60° C., there is a possibility that insufficient fixability is exhibited.

The measurement of $T_g$ is made with a DSC. A examples of such an apparatus includes an differential scanning calorimeter SSC-5200, manufactured by Seiko Instruments Inc., Japan. The $T_g$ of a resin may be measured under the following conditions. About 10 mg of the resin is weighed out and placed in an aluminum cell. This cell is set on the DSC, and $N_2$ gas is introduced thereinto at a rate of 50 ml/min. Subsequently the resin is heated from 20° C. to 150° C. at a rate of 10° C./min and then quenched from 150° C. to 20° C. This operation is repeatedly conducted two times in total to measure the quantity of the resulting heat of absorption; the $T_g$ is determined from the results of the second measurement. The $T_g$ herein means the temperature corresponding to the point at which the base line intersects with the tangential line having the maximum inclination angle in the range of from the initiation to the termination of heat absorption.

Examples of the reactive monomer used for crosslinking the above-described binder resin having an unsaturated double bond include styrene and derivatives thereof such as α-methylstyrene and chlorostyrene; acrylic esters such as methyl acrylate, ethyl acrylate, propyl acrylate, butyl acrylate, octyl acrylate, and other alkyl acrylates; methacrylic esters such as methyl methacrylate, ethyl methacrylate, propyl methacrylate, butyl methacrylate, octyl methacrylate, stearyl methacrylate, glycidyl methacrylate, and other alkyl methacrylates; and vinyl monomers such as acrylonitrile, maleic acid, maleic esters, methyl methacrylate, methyl acrylate, vinyl chloride, vinyl acetate, vinyl benzoate, vinyl methyl ketone, vinyl hexyl ketone, vinyl methyl ether, vinyl ethyl ether, and vinyl isobutyl ether. The content of the reactive monomer is generally from 0.8 to 1.5 mole per 1 mole of an unsaturated double bond contained in the binder resin.

An azo compound or an organic peroxide may be used as the radical-polymerization catalyst of the present invention. Of these, an organic peroxide is preferred from the standpoint of reactivity. Examples of the organic peroxide include ketone peroxides such as methyl ethyl ketone peroxide, cyclohexane peroxide, 3,3,5-trimethylcyclohexane peroxide, methylcyclohexane peroxide, methyl acetoacetate peroxide, and acetylacetone peroxide; peroxyketals such as 1,1-bis(t-butylperoxy)-3,3,5-trimethylcyclohexane, 1,1-bis(t-butylperoxy)cyclohexane, 2,2-bis(t-butylperoxy)octane, dibutyl 4,4-bis(t-butylperoxy)valeate, and 2,2-bis(t-butylperoxy)butane; hydroperoxides such as t-butyl hydroperoxide, cumene hydroperoxide, diisopropylbenzene hydroperoxide, p-methane hydroperoxide, 2,5-dimethylhexane 2,5-dihydroperoxide, and 1,1,3,3-tetramethylbutyl hydroperoxide; dialkyl peroxides such as di-t-butyl peroxide, t-butyl cumyl peroxide, dicumyl peroxide, α,α'-bis(t-butylperoxy-m-isopropyl)benzene, 2,5-dimethyl-2,5-di(t-butylperoxy)hexane, and 2,5-dimethyl-2,5-di(t-butylperoxy)hexane-3; acyl peroxides such as acetyl peroxide, isobutyl peroxide, octanoyl peroxide, decanoyl peroxide, lauroyl peroxide, 3,5,5-trimethylhexanoyl peroxide, succinic acid peroxide, benzoyl peroxide, 2,4-dichlorobenzoyl peroxide, and m-toluoyl peroxide; peroxydicarbonates such as diisopropyl peroxydicarbonate, di-2-ethylhexyl peroxydicarbonate, di-2-propyl peroxydicarbonate, bis(4-t-butylcyclohexyl) peroxydicarbonate, dimyristyl peroxydicarbonate, di-2-ethoxyethyl peroxydicarbonate, dimethoxyisopropyl peroxydicarbonate, di(3-methyl-3-methoxybutyl) peroxydicarbonate, and diallyl peroxydicarbonate; and peroxyesters such as t-butyl peroxyacetate, t-butyl peroxyisobutyrate, t-butyl peroxypivalate, t-butyl peroxyneodecanoate, cumyl peroxyneodecanoate, t-butyl peroxy-2-ethylhexanoate, t-butyl peroxy-3,5,5-trimethylhexanoate, t-butyl peroxylaurate, t-butyl peroxybenzoate, di-t-butyl peroxyisophthalate, 2,5-dimethyl-2,5-di(benzoylperoxy)hexane, t-butyl peroxymaleate, t-butyl peroxyisopropylcarbonate, cumyl peroxyoctoate, t-hexyl peroxypivalate, t-butyl peroxyneohexanoate, t-hexyl peroxyneohexanoate, and cumyl peroxyneohexanoate. The content of the radical-polymerization catalyst is generally from 0.5 to 10 parts by weight per 100 parts by weight of the binder resin.

A crosslinking accelerator may be used in combination with the above-described organic peroxide in the process of the present invention for the purpose of accelerating the crosslinking reaction so that the reaction can be completed in a reduced time period at a low temperature. Examples of the crosslinking accelerator include metal soaps such as cobalt naphthenate, manganese naphthenate, and vanadium octylate; amines such as dimethylaniline, phenylmorpholine, diethylenetriamine, triethylenetetramine, tetraethylenepentamine, diethylaminopropylamine, m-phenylenediamine, diaminodiphenylmethane, diaminodiphenyl sulfone, m-xylene diamine, m-aminobenzylamine, benzidine, 4-chloro-o-phenylenediamine, bis(3,4-diaminophenyl) sulfone, and 2,6-diaminopyridine; phosphorus compounds such as phenylphosphinic acid; and metal chelate compounds such as vanadylacetylacetonate and aluminum acetylacetonate. The content of the crosslinking accelerator is generally from 0.2 to 2 parts by weight per 100 parts by weight of the binder resin.

In the first process for producing the electrophotographic toner of the present invention, a binder resin having an unsaturated double bond, a reactive monomer, and a radical-polymerization catalyst and optional additives including a colorant are first mixed by means of a Henschel mixer or the like to obtain a mixture. This mixture is melt-kneaded with heating by means of a melt-kneading device such as a roll mill, pressure kneader, Banbury mixer, or extruder. The melt-kneading temperature is generally from 100° to 150° C. Though the reactive monomer may partially react during melt-kneading step to thereby cause crosslinking, such a small degree of crosslinking is advantageous in improvement of offset resistance. After kneading, the composition obtained is pulverized with a pulverizer such as a jet mill or a turbo mill, and the resulting particles are classified with an air classifier to obtain toner particles regulated to have a desired particle diameter distribution. Thereafter, these toner particles are subjected to a heat treatment, or a mechanical impact force is applied thereto. The toner particles are thus cured so that the crosslinking density in each toner particle gradationally increases toward the surface thereof.

In the second process for producing the electrophotographic toner of the present invention, a binder resin having an unsaturated double bond and a colorant and optional additive ingredients are first mixed by means of a Henschel mixer or the like to obtain a mixture, which is then melt-kneaded. Usable melt-kneading devices include a roll mill, a pressure kneader, a Banbury mixer, and an extruder. After kneading, the composition obtained is pulverized with a pulverizer such as a jet mill or a turbo mill, and the resulting particles are classified with an air classifier to obtain toner particles regulated to have a desired particle diameter distribution. A reactive monomer and a radical-polymerization catalyst are then adhered to these toner particles using an agitator such as a Henschel mixer. Thereafter, the resulting particles are subjected to a heat treatment, or a mechanical impact force is applied thereto, thereby curing the toner particles so that the crosslinking density in each toner particle gradationally increases toward the surface thereof. Thus, the toner for electrophotography of the present invention is produced.

For the heat treatment in the first and second processes described above, a mixer capable of applying a high-speed shear force, e.g., a supermixer, Henschel mixer, or turburizer, can be used. Upon mixing with such a mixer, frictional heat generates on the toner surface and, as a result, the crosslinking reaction proceeds. In the case where further acceleration of the crosslinking is desired, the mixer may be provided with, e.g., a means for passing warm water through the jacket thereof to heat the contents or a means for introducing hot air into the mixer.

For the application of a mechanical impact force to toner particles in the first and second processes described above, use may be made of a Hybridizer (manufactured by Nara Machinery Co., Ltd., Japan), Angmill (manufactured by Hosokawa Micron Corporation, Japan), or the like which are commercially available as a surface-modifying machine. The heat treatment of toner particles may be conducted by means of a fluidized hot bed using, e.g., Surfusing System (manufactured by Nippon Newmatic Co.) or a Spinning Fluid type drier (manufactured by Okawara Mfg. Co., Ltd., Japan).

For gradationally increasing the crosslinking density toward the surface of the toner particles in this invention, use may be made of a technique of controlling the set temperature and heating time in the operation of, e.g., a mixer or a surface-modifying machine. For example, in the case of the hybridizer manufactured by Nara Machinery Co., Ltd., the treatment may be performed at 6,000 rpm for 10 minutes.

One measure of the initiation of the cure of the toner particle surface is to ascertain the nonoccurrence of inter-particulate blocking in a test in which 20 g of the toner particles are placed in a 200-cc polyethylene bottle and allowed to stand for 16 hours in a thermostatic chamber kept at 50° C. On the other hand, a measure of the completely cured state in which each particle has been wholly cured as a result of thermal curing and the crosslinking density no longer decreases gradationally inward from the surface thereof is to ascertain that the toner particles have a melting initiation temperature as measured with a Koka-type flow tester of 100° C. or higher.

The term "melting initiation temperature" means the temperature at which the plunger begins to descend.

Examples of the Koka-type flow tester for measuring the melting initiation temperature include CFT-500, manufactured by Shimadzu Corporation, Japan. This measurement is made under the following conditions.

Plunger: 1 $cm^2$
Diameter of the die: 1 mm
Length of the die: 1 mm
Load: 20 kgf
Preheating temperature: 50°–80° C.
Preheating time: 3,000 sec
Rate of heating: 6° C./min A further heightened crosslinking density in the toner surface may be attained by incorporating the above-described crosslinking accelerator into the toner particles in the first process or by adhering the crosslinking accelerator to the surface of the toner particles in the second process, before carrying out the heat treatment. In the latter method, the classified toner particles are introduced into an agitator simultaneously with a reactive monomer, a radical-polymerization catalyst, and the crosslinking accelerator, and these ingredients are agitated together to thereby evenly adhere the monomer, catalyst, and accelerator to the toner particle surface. The surface of the resulting toner particles is then cured by heating in the same manner as described above.

Besides the ingredients described above, other kinds of binder resins and property modifiers may be used in the toner particles of the present invention. Examples of the property modifiers include colorants, magnetic materials, charge control agents, fluidizing agents, and offset inhibitors.

Examples of other kinds of binder resins that may be compounded in the toner for electrophotography of the present invention besides the binder resin having an unsaturated double bond include polyethylene resins, epoxy resins, silicone resins, polyamide resins, polyurethane resins, polystyrene resins, and styrene-acrylic ester copolymer resins.

Examples of the colorants for use in the toner for electrophotography of the present invention include carbon black, Nigrosine dyes, aniline blue, Chalco Oil Blue, chrome yellow, ultramarine blue, Dupont Oil Red, quinoline yellow, methylene blue chloride, phthalocyanine blue, malachite green oxalate, lamp black, Rose Bengal, and mixtures thereof. These colorants should be incorporated in a proportion sufficient for forming a visible image having a sufficient density. The proportion thereof is usually about from 1 to 20 parts by weight per 100 parts by weight of the binder resin. Colorant proportions smaller than 1 part by weight result in insufficient coloring, while colorant proportions exceeding 20 parts by weight result in inclusion of a colorant ineffective in coloring.

Examples of the magnetic materials for use in this invention include ferromagnetic metals (e.g., iron, cobalt, nickel, etc.), alloys thereof, or compounds including these elements, such as ferrite and magnetite; alloys which contain no ferromagnetic elements but become ferromagnetic upon an appropriate heat treatment, such as the alloys containing manganese and copper and called Heusler alloys, e.g., manganese-copper-aluminum alloys and manganese-copper-tin alloys; and chromium dioxide. These magnetic materials are evenly dispersed into the binder resin in the form of a fine powder having an average particle diameter of from 0.1 to 1 μm. The content thereof is from 20 to 70 parts by weight, preferably from 40 to 70 parts by weight, per 100 parts by weight of the toner. Contents of the magnetic materials lower than 20 parts by weight are undesirable in that the toner has an insufficient magnetic force and is incapable of forming a magnetic brush to cause a problem concerning image formation. On the other hand, contents thereof higher than 70 parts by weight are undesirable in that the toner has too high a magnetic force, resulting in an insufficient image density and impaired fixability.

With respect to the melting characteristics of the toner for electrophotography of the present invention, the melting initiation temperature of the toner is preferably not lower than 60° C. and not higher than 100° C. from the standpoint of attaining improved low-temperature fixability. If the melting initiation temperature of the toner is higher than 100° C., insufficient fixability results. If the melting initiation temperature thereof is lower than 60° C., there are cases where anti-blocking properties are impaired to cause a problem concerning storage stability.

The toner for electrophotography of the present invention is mixed with a carrier comprising a ferrite powder, an iron powder, or the like, giving a two-component developer. In the case where the toner contains a magnetic material, the toner may be used not as a mixture with a carrier but as it is as a one-component developer for the development of electrostatic images, or may be used as a two-component developer after being mixed with a carrier. The toner of this invention is also applicable to development with a non-magnetic one-component developer.

The following are the reasons why the toner for electrophotography of the present invention is characterized by containing at least a binder resin having an unsaturated double bond, a radical-polymerization catalyst, a reactive monomer, and a colorant.

For improving fixability, a technique of using a styrene or polyester resin having a lowered molecular weight to attain a reduction in melting initiation temperature, melt viscosity, or $T_g$ to thereby impart the effect of anchoring to paper has been employed. However, the toners produced by this technique have impaired anti-blocking properties due to the reduced $T_g$.

In contrast, by incorporating a resin having an unsaturated double bond into a toner and curing the toner surface with a reactive monomer and a catalyst, the $T_g$ and strength of the surface resin are increased, so that the insufficient heat resistance can be improved.

The present invention will be explained below by reference to Examples. In these Examples, all parts are by weight.

EXAMPLE 1

Polycondensation was conducted using an alcohol ingredient consisting of 85 mol % propylene oxide adduct of bisphenol A and 15 mol % trimethylolpropane and an acid ingredient consisting of 95 mol % fumaric acid. Thus, polyester resin A having a peak molecular weight of 7,500 and a $T_g$ of 57° C. was obtained.

| | |
|---|---|
| Polyester resin A | 100 parts |
| Carbon black (trade name, MA-100; manufactured by Mitsubishi Kasei Corporation, Japan) | 6.5 parts |
| Metallized dye containing chromium (trade name, S-34; manufactured by Orient Chemical Industries, Ltd., Japan) | 2 parts |
| Polypropylene (trade name, Viscol 330P, manufactured by Sanyo Chemical Industries, Ltd., Japan) | 3 parts |

The ingredients specified above were mixed together in the proportion shown above with a supermixer. The resulting mixture was thermally melted and kneaded with a twin-screw extruder, pulverized with a jet mill, and then classified in a dry state with an air classifier. Thus, toner particles having an average particle diameter of 10 μm were obtained.

100 Parts by weight of the toner particles were introduced into a Henschel mixer along with 1 part by weight of styrene monomer, 0.2 parts by weight of benzoyl peroxide, and 0.01 part by weight of dimethylaniline, and the contents were agitated for 5 minutes.

The resulting toner particles were treated with a hybridizer (manufactured by Nara Machinery Co., Ltd.) at 6,000 rpm for 10 minutes. A mixture of 100 parts of the thus-treated toner particles and 0.4 parts of hydrophobic silica (trade name, Cab-O-Sil TS-530; manufactured by Cabot Corp.) was agitated with a Henschel mixer for 1 minute to adhere the hydrophobic silica to the surface of the particles. Thus, a toner for electrophotography according to the present invention was obtained, which had a melting initiation temperature of 92.5° C.

EXAMPLE 2

| | |
|---|---|
| Polyester resin A | 100 parts |
| Carbon black (trade name, MA-100; manufactured by Mitsubishi Kasei Corporation) | 6.5 parts |
| Metallized dye containing chromium (trade name, S-34; manufactured by Orient Chemical Industries, Ltd.) | 2 parts |
| Polypropylene (trade name, Viscol 330P, manufactured by Sanyo Chemical Industries, Ltd.) | 3 parts |

The ingredients specified above were mixed together in the proportion shown above with a supermixer. The resulting mixture was thermally melted and kneaded with a twin-screw extruder, pulverized with a jet mill, and then classified in a dry state with an air classifier. Thus, toner particles having an average particle diameter of 10 μm were obtained.

100 Parts by weight of the toner particles were introduced into a Henschel mixer along with 2 parts by weight of styrene monomer, 0.04 parts by weight of methyl ethyl ketone peroxide, and 0.04 parts by weight of cobalt naphthenate, and the contents were agitated for 5 minutes.

The resulting toner particles were treated with a hybridizer (manufactured by Nara Machinery Co., Ltd.) at 6,000 rpm for 10 minutes. A mixture of 100 parts of the thus-treated toner particles and 0.4 parts of hydrophobic silica (trade name, Cab-O-Sil TS-530; manufactured by Cabot Corp.) was agitated with a Henschel mixer for 1 minute to adhere the hydrophobic silica to the surface of the particles. Thus, a toner for electrophotography according to the present invention was obtained, which had a melting initiation temperature of 93.6° C.

EXAMPLE 3

Polycondensation was conducted using an alcohol ingredient consisting of 85 mol % propylene oxide adduct of bisphenol A and 15 mol % trimethylolpropane and an acid ingredient consisting of 85 mol % fumaric acid and 10 mol % dodecenylsuccinic acid. Thus, polyester resin B having a peak molecular weight of 7,300 and a $T_g$ of 52° C. was obtained.

| | |
|---|---|
| Polyester resin B | 100 parts |
| Carbon black (trade name, MA-100; manufactured by Mitsubishi Kasei Corporation) | 6.5 parts |
| Metallized dye containing chromium (trade name, S-34; manufactured by Orient Chemical Industries, Ltd.) | 2 parts |
| Polypropylene (trade name, Viscol 330P, manufactured by Sanyo Chemical Industries, Ltd.) | 3 parts |

The ingredients specified above were mixed together in the proportion shown above with a supermixer. The resulting mixture was thermally melted and kneaded with a twin-screw extruder, pulverized with a jet mill, and then classified in a dry state with an air classifier. Thus, toner particles having an average particle diameter of 10 μm were obtained.

100 Parts by weight of the toner was introduced into a Henschel mixer along with 5 parts by weight of styrene monomer, 0.1 part by weight of methyl ethyl ketone peroxide, and 0.1 part by weight of cobalt naphthenate, and the contents were agitated for 5 minutes.

The resulting toner particles were treated with a hybridizer (manufactured by Nara Machinery Co., Ltd.) at 6,000 rpm for 10 minutes. A mixture of 100 parts of the thus-treated toner particles and 0.4 parts of hydrophobic silica (trade name, Cab-O-Sil TS-530; manufactured by Cabot Corp.) was agitated with a Henschel mixer for 1 minute to adhere the hydrophobic silica to the surface of the particles. Thus, a toner for electrophotography according to the present invention was obtained, which had a melting initiation temperature of 90.1° C.

EXAMPLE 4

Polycondensation was conducted using an alcohol ingredient consisting of 85 mol % propylene oxide adduct of bisphenol A and 15 mol % trimethylolpropane and an acid ingredient consisting of 65 mol % fumaric acid and 30 mol % dodecenylsuccinic acid. Thus, polyester resin C having a peak molecular weight of 7,600 and a $T_g$ of 49° C. was obtained.

| | |
|---|---|
| Polyester resin C | 100 parts |
| Carbon black (trade name, MA-100; manufactured by Mitsubishi Kasei Corporation) | 6.5 parts |
| Metallized dye containing chromium (trade name, S-34; manufactured by Orient Chemical Industries, Ltd.) | 2 parts |
| Polypropylene (trade name, Viscol 330P, manufactured by Sanyo Chemical Industries, Ltd.) | 3 parts |

The ingredients specified above were mixed together in the proportion shown above with a supermixer. The resulting mixture was thermally melted and kneaded with a twin-screw extruder, pulverized with a jet mill, and then classified in a dry state with an air classifier. Thus, toner particles having an average particle diameter of 10 μm were obtained.

100 Parts by weight of the toner particles were introduced into a Henschel mixer along with 5 parts by weight of styrene monomer, 0.1 part by weight of methyl ethyl ketone peroxide, and 0.1 part by weight of cobalt naphthenate, and the contents were agitated for 5 minutes.

The resulting toner was treated with a hybridizer (manufactured by Nara Machinery Co., Ltd.) at 6,000 rpm for 10 minutes. A mixture of 100 parts of the thus-treated toner particles and 0.4 parts of hydrophobic silica (trade name, Cab-O-Sil TS-530; manufactured by Cabot Corp.) was agitated with a Henschel mixer for 1 minute to adhere the hydrophobic silica to the surface of the particles. Thus, a toner for electrophotography according to the present invention was obtained, which had a melting initiation temperature of 88.9° C.

EXAMPLE 5

Polycondensation was conducted using an alcohol ingredient consisting of 85 mol % propylene oxide adduct of bisphenol A and 15 mol % trimethylolpropane and an acid ingredient consisting of 95 mol % fumaric acid. Thus, polyester resin A having a peak molecular weight of 7,500 and a $T_g$ of 57° C. was obtained.

| | |
|---|---|
| Polyester resin A | 100 parts |
| Styrene monomer | 5 parts |
| Benzoyl peroxide | 1 part |
| Carbon black (trade name, MA-100; manufactured by Mitsubishi Kasei Corporation) | 6.5 parts |
| Metallized dye containing chromium (trade name, S-34; manufactured by Orient Chemical Industries, Ltd.) | 2 parts |
| Polypropylene (trade name, Viscol 330P, manufactured by Sanyo Chemical Industries, Ltd., Japan) | 3 parts |

The ingredients specified above were mixed together in the proportion shown above with a supermixer. The resulting mixture was thermally melted and kneaded with a twin-screw extruder, pulverized with a jet mill, and then classified in a dry state with an air classifier. Thus, toner particles having an average particle diameter of 10 μm were obtained.

The toner obtained was repeatedly subjected three times to a 10-minute treatment with a hybridizer (manufactured by Nara Machinery Co., Ltd.) at 6,000 rpm. A mixture of 100 parts of the thus-treated toner particles and 0.4 parts of hydrophobic silica (trade name, Cab-O-Sil TS-530; manufactured by Cabot Corp.) was agitated with a Henschel mixer for 1 minute to adhere the hydrophobic silica to the surface of the particles. Thus, a toner for electrophotography according to the present invention was obtained, which had a melting initiation temperature of 99.1° C.

COMPARATIVE EXAMPLE 1

A comparative toner for electrophotography was obtained in the same manner as in Example 1, except that the following polyester D having no unsaturated double bond was used in place of polyester A. This toner had a melting initiation temperature of 101.9° C.

Polyester resin D having a number-average molecular weight of 7,500 and a $T_g$ of 59.0° C. was obtained by conducting polycondensation using an alcohol ingredient consisting of 100 mol % propylene oxide adduct of bisphenol A and an acid ingredient consisting of 55 mol % isophthalic acid, 45 mol % terephthalic acid, and 5 mol % trimellitic acid.

COMPARATIVE EXAMPLE 2

A comparative toner for electrophotography was obtained in the same manner as in Example 1, except that benzoyl peroxide as a radical-polymerization catalyst for the toner and dimethylaniline were not used. This toner had a melting initiation temperature of 91.2° C.

COMPARATIVE EXAMPLE 3

A comparative toner for electrophotography was obtained in the same manner as in Example 1, except that styrene monomer as a reactive monomer for the toner was not used. This toner had a melting initiation temperature of 91.4° C.

The toners obtained in the Examples and Comparative Examples given above were subjected to the following tests.

(1) Fixing Strength

Four parts of each of the electrophotographic toners obtained in the Examples and Comparative Examples was mixed with 96 parts of a resin-uncoated ferrite carrier (trade name, FL-1020; manufactured by Powder Tec Co.) to prepare a two-component developer. This developer was used in a commercially available copier (trade name, SF-9800; manufactured by Sharp Corporation, Japan) to form unfixed rectangular images each having a width of 2 cm and a length of 5 cm on a A4-size receiving paper.

The unfixed toner images thus formed on the receiving paper were then fixed using a fixing apparatus having a pair of fixing rolls consisting of a heat roll having a surface layer made of a fluororesin (trade name, Teflon; manufactured by E. I. du Pont de Nemours and Co.) and a pressure roll having a surface layer made of a silicone rubber. This fixing apparatus was operated at a rolling pressure of 1 kg/cm$^2$, a rolling speed of 50 mm/sec, and a surface temperature of the heat roll of 120° C. A cotton pad was then rubbed against the thus-formed fixed images, and the fixing strength as a measure of low-energy fixability was calculated using the following equation. The image densities were measured with a reflective densitometer RD-914, manufactured by Macbeth Co.

$$\text{Fixing strength (\%)} = \frac{\text{Density of fixed image after rubbing}}{\text{Density of fixed image before rubbing}} \times 100$$

(2) Storage Stability

Twenty grams of each of the electrophotographic toners obtained in the Examples and Comparative Examples was placed in a 200-cc polyethylene bottle, allowed to stand for 16 hours in a thermostatic chamber kept at 50° C., and then cooled to ordinary temperature. The toner was then taken out and visually evaluated for toner blocking based on the following criteria.

A: Entirely free from toner fusion and unchanged from the state before standing.

B: Slight decrease in flowability but no coarse agglomerates.

C: Toner agglomeration is observed but the agglomerates readily disaggregate when lightly pressed with a finger.

D: Coarse agglomerates incapable of being disaggregated by pressing with a finger have been formed as a result of toner fusion.

The results of the above tests are shown in Table. No sample was rated as "C" in terms of storage stability.

TABLE

| Example No. | Fixing Strength (%) | Storage Stability |
|---|---|---|
| Example 1 | 90 | A |
| Example 2 | 94 | A |
| Example 3 | 99 | B |
| Example 4 | 100 | B |
| Example 5 | 85 | B |
| Comparative Example 1 | 75 | D |
| Comparative Example 2 | 88 | D |
| Comparative Example 3 | 82 | D |

As apparent from the test results shown in Table, the electrophotographic toners of the present invention were ascertained to have a fixing strength of 80% or higher when fixed at a temperature of 120° C., which strength is sufficient for practical use.

In contrast, the toners of the Comparative Examples were ascertained to undergo blocking in the storage stability test and hence cause a problem in practical use.

The developers prepared in the evaluation of the fixing strength described above each was subjected to a copying test in which 10,000 copies were continuously produced using a commercially available copier (trade name, BD-3801, manufactured by Toshiba Corporation, Japan). As a result, with respect to each of the developers of Examples 1 to 5, the amount of friction charge was within the range of from −20 μc/g to −25 μc/g throughout the copies of from the 1st to the 10,000th copies, and the image density was within the range of from 1.45 to 1.40 throughout the copies of from the 1st to the 10,000th copies. Thus, those developers were ascertained to cause no problems in practical use. The original used in this copying test was an A4-size original having a percentage of black parts of 6%. The amount of friction charge was measured with a blow-off type apparatus for measuring the amount of friction charge manufactured by Toshiba Chemical Corporation, Japan. The image density was measured with a reflective densitometer RD-914, manufactured by Macbeth Co.

The toner for electrophotography of the present invention has the effects of being fixable at low temperatures, excellent in storage stability, and capable of giving a large number of copies having a sufficient image density.

While the invention has been described in detail and with reference to specific embodiments thereof, it will be apparent to one skilled in the art that various changes and modifications can be made therein without departing from the spirit and scope thereof.

What is claimed is:

1. A toner for electrophotography comprising particles each having a center and a surface and being formulated from at least a cured composition, the composition in an uncured state comprising a binder resin having an unsaturated double bond, a reactive monomer, and a radical-polymerization catalyst, wherein the particles each have a crosslinking density that gradationally increases from the center towards the surface thereof.

2. The toner of claim 1, wherein the binder resin having an unsaturated double bond is an unsaturated polyester resin.

3. The toner of claim 1, wherein the binder resin having an unsaturated double bond has a glass transition point of 60° C. or lower.

4. The toner of claim 1, wherein the toner has a melting initiation temperature of from 60° C. to 100° C.

5. A toner for electrophotography comprising particles each having a center and a surface and being formulated from at least a cured composition, the composition in an uncured state comprising a binder resin having an unsaturated double bond, the binder resin being partially crosslinked such that the particles each have a crosslinking density that gradationally increases from the center towards the surface thereof.

6. A process for producing a toner for electrophotography comprising:

curing toner-forming particles containing at least a binder resin having an unsaturated double bond, a reactive monomer, and a radical-polymerization catalyst and applying a heat treatment or a mechanical impact force to produce toner particles, wherein each of the toner particles has a crosslinking density that gradationally increases toward a surface thereof.

7. A process according to claim 6, wherein the radical-polymerization catalyst is an organic peroxide.

8. A process according to claim 6, wherein the toner-forming particles contain a crosslinking accelerator.

9. A process according to claim 6, further comprising adhering the reactive monomer and the radical-polymerization catalyst to the surfaces of the toner particles.

10. A process according to claim 9, wherein the radical-polymerization catalyst is an organic peroxide.

11. A process according to claim 9, wherein said adhering step further comprises adhering a crosslinking accelerator to the surfaces of the toner particles.

12. A process for producing a toner for electrophotography comprising:

mixing at least a binder resin having an unsaturated double bond, a reactive monomer, a radical-polymerization catalyst, and a colorant to prepare a mixture;

thermally melting and kneading the mixture to prepare a kneaded mixture;

pulverizing and classifying the kneaded mixture to obtain toner particles; and applying a heat treatment or a mechanical impact force to the toner particles.

13. A process according to claim 12, wherein the toner particles each have a crosslinking density that gradationally increases from a center towards a surface of the particle.

14. The process according to claim 13, wherein said applying step involves applying the heat treatment to the toner particles.

15. The process according to claim 13, wherein said applying step involves applying the mechanical impact force to the toner particles.

16. A process for producing a toner for electrophotography comprising:

mixing at least a binder resin having an unsaturated double bond and a colorant to prepare a mixture;

thermally melting and kneading the mixture to prepare a kneaded mixture;

pulverizing and classifying the kneaded mixture to obtain toner particles having surfaces;

adding a reactive monomer and a radical-polymerization catalyst to the toner particles such that the reactive monomer and the radical-polymerization catalyst adhere to the surfaces of the toner particles; and applying a heat treatment or a mechanical impact force to the toner particles having the reactive monomer and the radical-polymerization catalyst adhered to the surfaces thereof.

17. A process according to claim 16, wherein the toner particles each have a crosslinking density that gradationally increases from a center towards the surface of the particle.

18. The process according to claim 17, wherein said applying step involves applying the heat treatment to the toner particles.

19. The process according to claim 17, wherein said applying step involves applying the mechanical impact force to the toner particles.

* * * * *